US005494259A

United States Patent [19]

Peterson

[11] Patent Number: 5,494,259

[45] Date of Patent: Feb. 27, 1996

[54] REINFORCED NON-METALLIC FAUCET BODY

[75] Inventor: Donald W. Peterson, North Olmsted, Ohio

[73] Assignee: Moen Incorporated, North Olmsted, Ohio

[21] Appl. No.: 366,735

[22] Filed: Dec. 30, 1994

[51] Int. Cl.[6] ..... F16K 21/00

[52] U.S. Cl. ..... 251/368; 251/366; 137/606; 137/801

[58] Field of Search ..... 137/606, 801; 251/366, 368

[56] References Cited

U.S. PATENT DOCUMENTS

| | | | |
|---|---|---|---|
| 4,037,624 | 7/1977 | Turner et al. | 137/801 |
| 4,484,600 | 11/1984 | Peterson et al. | 137/801 |
| 4,762,143 | 8/1988 | Botnick | 137/801 |
| 4,763,693 | 8/1988 | Valley | 137/801 |
| 5,131,428 | 7/1992 | Bory | 137/801 |
| 5,248,126 | 9/1993 | Prüss et al. | 251/368 |

*Primary Examiner*—A. Michael Chambers

*Attorney, Agent, or Firm*—Dorn, McEachran, Jambor & Keating

[57] ABSTRACT

A non-metallic faucet body has spaced hot and cold water hollow inlet shanks and a hollow body located generally centrally between the shanks. The hollow body is formed end adapted to mount a faucet control valve. There ere water conduits connecting the hollow inlet shanks and the hollow body. There is a reinforcing beam which supports the lower side of the conduits, with the beam extending between and being generally continuous from one shank to another. There are reinforcing elements for each of the shanks to resist shank failure from torque applied to the exterior thereof during installation of the faucet body.

6 Claims, 2 Drawing Sheets

REINFORCED NON-METALLIC FAUCET BODY

THE FIELD OF THE INVENTION

In order for faucet bodies to meet currently applicable building codes, they must meet two specific strength tests. Prior art non-metallic or plastic faucet bodies currently on the market generally do not meet the applicable requirements. Specifically, paragraphs 6.2.2 and 6.2.3 of Plumbing Fixture Fittings ASME A112.18.1M-1989 requires that the faucet body pass a bending strength test and a thread torque strength test. The present invention is specifically directed to reinforcing the body of the faucet to meet the bending strength test and to reinforcing the inlet conduit shanks to meet the thread torque strength test.

SUMMARY OF THE INVENTION

The present invention relates to faucet bodies of the type customarily found in the kitchen and bath and specifically to an all plastic faucet body which will meet the applicable codes relative to bending and torque tests.

Another purpose of the invention is to provide a nonmetallic faucet body with a reinforcing beam which extends across the length of the faucet body and will resist bending of the body between the spaced inlet shanks and the centrally located valve body.

Another purpose of the invention is to provide an all plastic faucet body of the type described in which each of the inlet shanks has axially extending and radially extending reinforcing ribs to strengthen the shank to resist the torque normally applied by the nuts threaded onto the exterior of the inlet shanks.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFACED EMBODIMENT

Figures 1, 2:
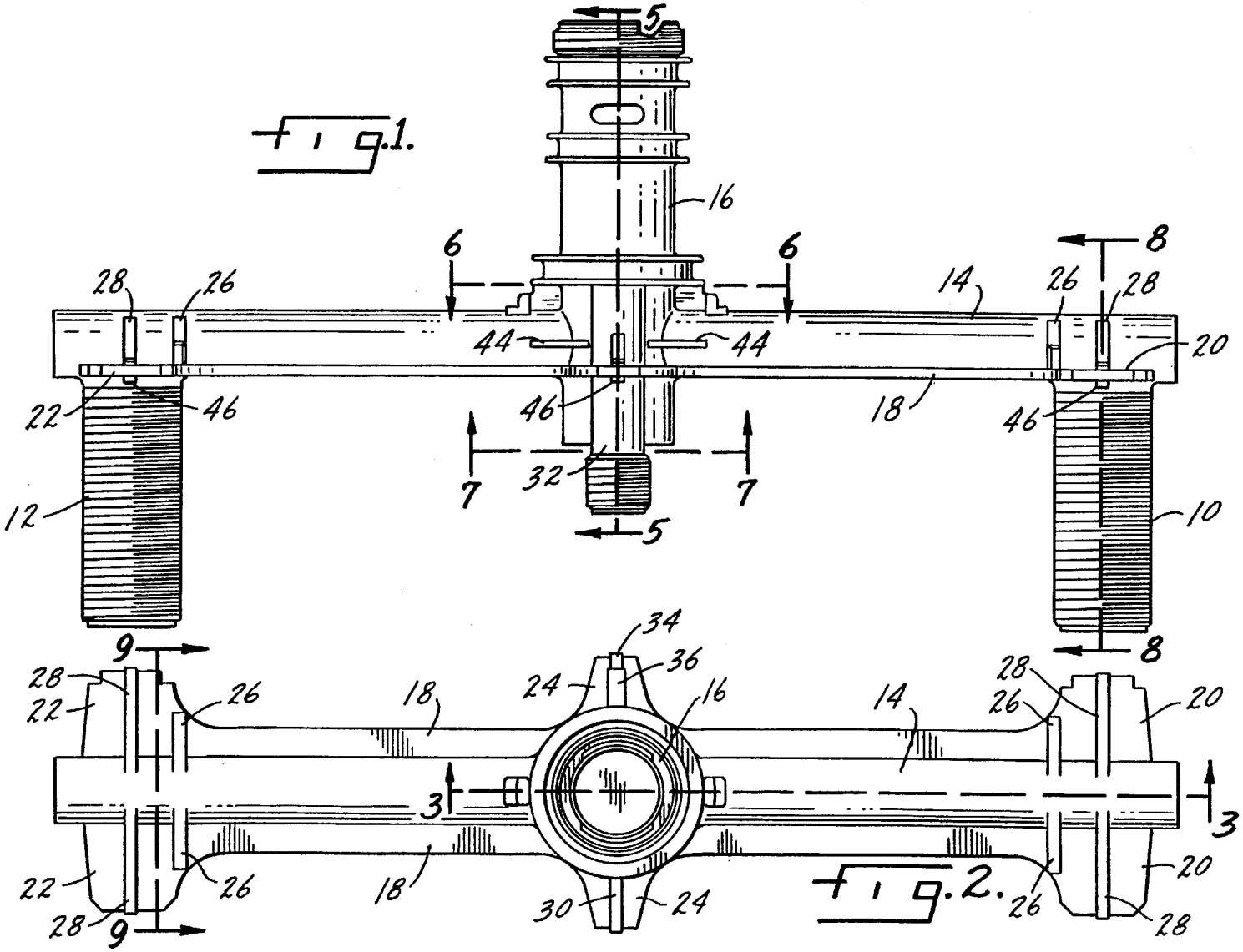
FIG. 1 is a front view of the faucet body of the present invention.
FIG. 2 is a top view of the faucet body.
Figure 3:
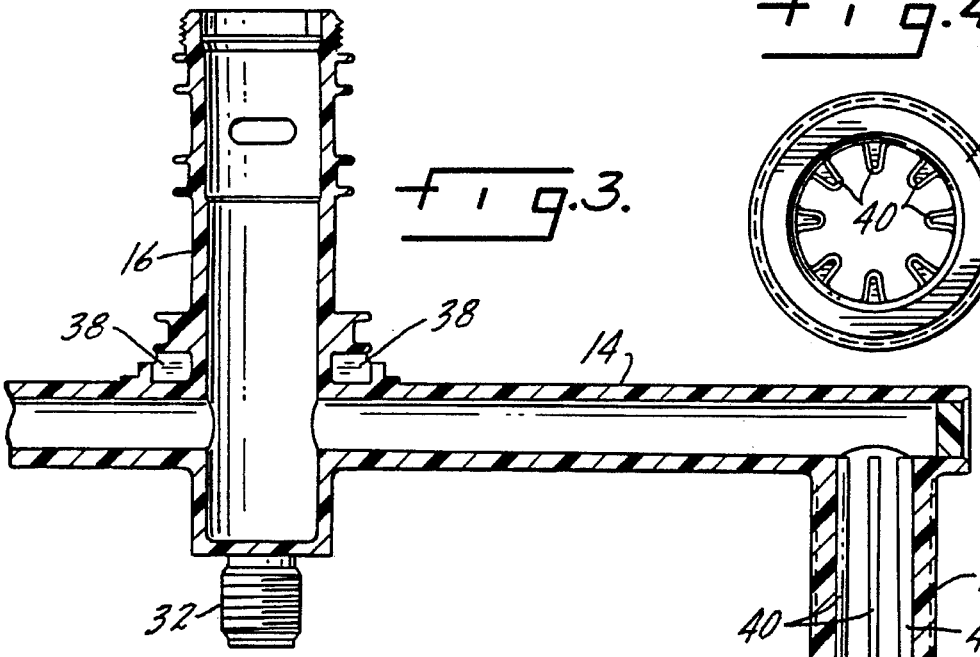
FIG. 3 is a section along plane 3—3 of FIG. 2.
Figure 4:
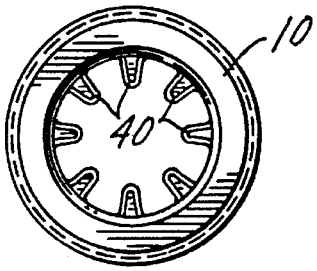
FIG. 4 is a bottom view of a shank.
Figure 6:
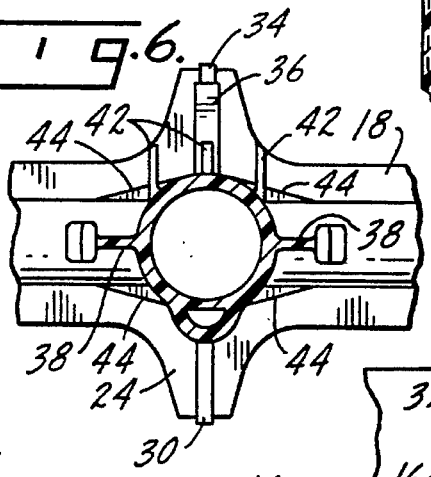
FIG. 6 is a section along plane 6—6 of FIG. 1.
Figure 5:
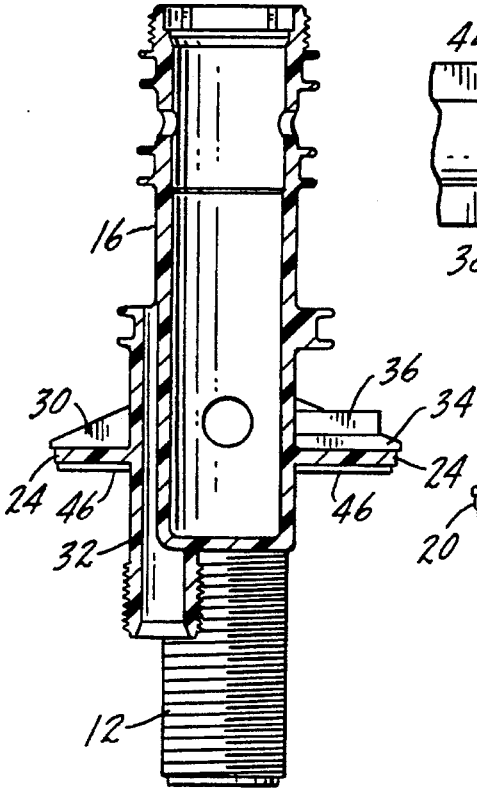
FIG. 5 is a section along plane 5—5 of FIG. 1.
Figure 7:
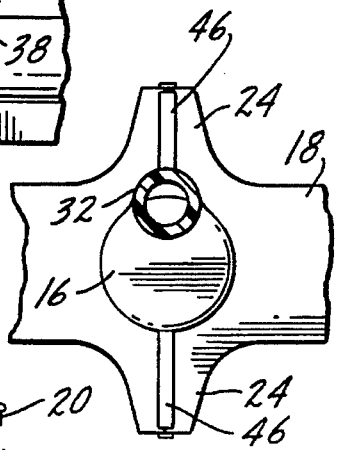
FIG. 7 is a section along plane 7—7 of FIG. 1.
Figure 8:
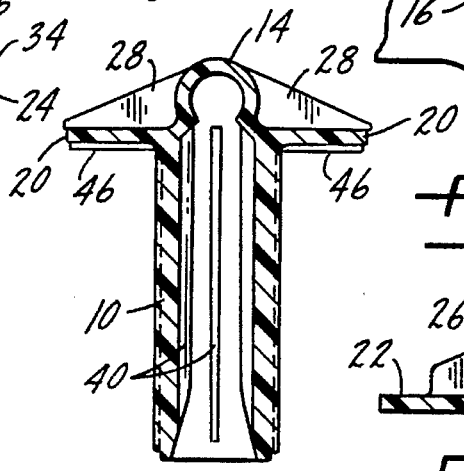
FIG. 8 is a section along plane 8—8 of FIG. 1.
Figure 9:
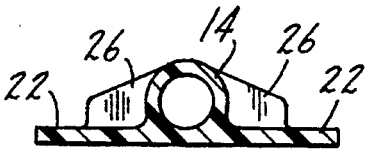
FIG. 9 is a section along plane 9—9 of FIG. 2.

In order to meet building codes, faucet bodies must pass both the bending strength test set forth in paragraph 6.2.2 and the thread torque strength test set forth in paragraph 6.2.3 of the Plumbing Fixture Fittings ASME A112.18.1M-1989 standards. Most current non-metallic faucets which are available in the market do not pass these tests. The present invention provides a full length support beam for the non-metallic faucet body so that it will pass the bending strength test and provides axially and radially inwardly extending support ribs on the inlet conduit shanks so that these elements will pass the thread torque strength test. The present invention provides a molded integral faucet body preferably formed of a polysulfone which has glass fibers distributed throughout the body for added strength.

As indicated in the drawings, the faucet body includes an exteriorly threaded hot water inlet shank 10 and an exteriorly threaded cold water inlet shank 12, each connected by an integral conduit indicated at 14, with a generally centrally located hollow valve body 16. The valve body 16 is formed and adapted to contain a faucet mixing valve of the type sold by the assignee of the present application, Moen Incorporated, under the trademark "1225". This valve provides for single handle manipulation to control the volume and temperature of the water passing from the inlet shanks 10 and 12, through the conduit 14, into the valve body 16 and to the faucet spout.

In order to support the shanks and conduit against failure from bending forces applied between the shanks or between either one of the shanks and the central valve body, there is a generally continuous reinforcing beam 18 integrally formed with the lower surface of the conduit. The reinforcing beam 18 has outwardly extending portions 20 and 22 adjacent the shanks to support the conduits at the outer end of their lateral extensions. The support beam 18 is continuous in the central area adjacent the valve body 16 and extends continuously about the valve body, as indicated at 24. For further support, there are fillets 26 and 28 which extend between the sides of the conduit 14 and the reinforcing beam 18 adjacent each of the shanks. The fillets being spaced and being of different lateral extent. There is a single fillet 30 between one side of the valve body 16 and the support beam 18 where the support beam extends around the valve body in the area adjacent the downwardly extending spray tube connection 32 which again is integrally formed with the entire faucet body. Spray tube connections are customarily found in kitchen faucets and there must be an outlet from the valve body to convey water to the spray discharge head. Directly opposite from the fillet 30 there is a further fillet 34.

There are further fillets 38 and 42 between the upper surface of conduit 14 and valve body 16. Additional reinforcement is provided by horizontal fillets 44 which extend between the valve body and the side of conduit 14. Fillets 46 provide further reinforcement between the bottom of beam 18 in the area of its lateral extensions 24.

Preferably, the non-metallic faucet body is formed of plastic and more specifically of a polysulfone and more particularly a polysulfone filled with glass fibers. Other plastics may be satisfactory, however, this particular type of material has been found to be quite successful in terms of providing a faucet body with extended life and one which has the required strength and rigidity.

In order to protect the shanks 10 and 12 from failure due to torque applied to the shanks during installation when nuts are run up onto the threaded exterior of the shanks, the interior of each shank has a plurality of generally uniformly spaced, axially extending and radially extending support ribs 40. Each of these support ribs will extend generally the entire axial length of the shank and will extend inwardly on a radius of the shank. Preferably, the ribs extend less than half of the full internal radius of the shanks with the length being determined by the necessity to provide the required resistance to torque, while not impeding the flow of water through the shanks. The thread torque strength test set forth in paragraph 6.2.3 referenced above requires that the shanks not fail at 45 ft. lbs. of applied torque and the design disclosed herein will pass this test when formed of the materials described.

Whereas the preferred form of the invention has been shown and described herein, it should be realized that there may be many modifications, substitutions and alterations thereto.

The embodiments of the invention in which an exclusive property or privilege is claimed are defined as follows:

1. A non-metallic faucet body including spaced hot and cold water hollow inlet shanks, a hollow body located generally centrally between said shanks and being formed and adapted to mount a faucet control valve therein, water conduits integral with and connecting the hollow inlet shanks and the hollow body, a reinforcing beam supporting the lower side of said conduits, said beam extending between and being generally continuous from one shank to another, and reinforcing means for each of said shanks to resist shank failure from torque applied thereto during installation of said non-metallic faucet body, said reinforcing means including a plurality of radially inwardly directed, axially extending, reinforcing ribs integral with said shank.

2. The non-metallic faucet body of claim 1 characterized in that said shanks, body and connecting conduits, as well as said reinforcing beam, are all integrally formed of a polysulfone plastic.

3. The non-metallic faucet body of claim 2 characterized in that said shanks are filled with glass fibers.

4. The non-metallic faucet body of claim 1 characterized in that said reinforcing beam has portions thereof which extend continuously about said hollow body.

5. The non-metallic faucet body of claim 1 characterized in that said reinforcing ribs are generally equally peripherally spaced and each extend a distance less than half of the internal radius of said shanks.

6. The non-metallic faucet body of claim 1 characterized in that each of said reinforcing ribs extend generally axially the entire internal length of said shanks.

* * * * *